United States Patent [19]

Caughey

[11] 4,199,028

[45] Apr. 22, 1980

[54] ENHANCED RECOVERY WITH GEOPRESSURED WATER RESOURCE

[75] Inventor: Charles A. Caughey, Lafayette, La.

[73] Assignee: Conoco, Inc., Ponca City, Okla.

[21] Appl. No.: 963,233

[22] Filed: Nov. 22, 1978

[51] Int. Cl.[2] ..... E21B 43/00; E21B 43/24

[52] U.S. Cl. ..... 166/314; 166/272

[58] Field of Search ..... 166/314, 272, 306, 263, 166/266, 267

[56] References Cited

U.S. PATENT DOCUMENTS

| | | | |
|---|---|---|---|
| 3,258,069 | 6/1966 | Hottman | 166/306 X |
| 3,294,167 | 12/1966 | Vogel | 166/272 |
| 3,354,952 | 11/1967 | Engle | 166/306 X |
| 3,361,202 | 1/1968 | Whipple | 166/306 X |
| 3,679,264 | 7/1972 | Van Huisen | 166/272 X |
| 3,805,885 | 4/1974 | Van Huisen | 166/272 X |
| 4,040,487 | 8/1977 | Cook, Jr. et al. | 166/314 |

OTHER PUBLICATIONS

National Academy of Sciences, Report No. FE-2271-1, "Natural Gas from Unconventional Geologic Sources", Board on Mineral Resources, Commission on Natural Resources, Contract E(49-18)-2271, Jan. 15, 1976, Wash., D.C.

*Primary Examiner*—Stephen J. Novosad
*Attorney, Agent, or Firm*—A. Joe Reinert

[57] ABSTRACT

Geopressurized gas (methane) containing aquifers are produced into relatively low pressure reservoirs such as depleted or partially depleted oil and gas reservoirs. Primary production of the methane in the water is effected by exsolvation upon entering the low pressure reservoir and movement through the reservoir to production walls. Enhanced recovery of hydrocarbons remaining in depleted or partially depleted reservoirs results from one or more of (1) the sweeping action of the methane moving through the reservoir, (2) pressure maintenance and water drive associated with injection of the naturally pressured water, and (3) reservoir heating caused by the higher temperature of the injected geopressured water.

4 Claims, 1 Drawing Figure

ENHANCED RECOVERY WITH GEOPRESSURED WATER RESOURCE

BACKGROUND OF THE INVENTION

This invention relates to recovery of natural gas from geopressured gas-containing aquifers.

In an important application, geopressured gas-containing aqueous liquid is employed for enhanced recovery of hydrocarbons from a reservoir at least partially depleted by primary recovery methods.

BRIEF DESCRIPTION OF THE PRIOR ART

Natural Gas from Unconventional Geologic Sources, Board of Mineral Resources, Commission on Natural Resources, National Academy of Sciences, Washington, D.C., Contract E (49-18)-2271 (1976) reporting on a forum convened at the National Academy of Sciences, Washington, D.C., on Jan. 15, 1976, provides excellent background on a resource comprising natural gas in geopressured aqueous zones in the northern Gulf of Mexico basin. An estimated 3,000 trillion cubic feet to 100,000 trillion cubic feet of methane is estimated to be contained in the resource. Temperatures range from 300° to 500° F. (160° to 300° C.). The gas dissolved in hot water in the aquifers to the resource is found in reservoirs at depths ranging from 9,000 feet to about 25,000 feet at geopressures approaching that of the weight per unit area of the sedimentary column overlying the aquifer, which greatly exceeds the weight per unit area of a column of seawater overlying the aquifer.

The foregoing report, No. FE-2271-1, discloses a proposal for recovering gas from the Gulf Coast geopressured resource by producing from the aquifer to lower pressure, letting gas exsolve into structural highs, and then producing gas from the thus-formed gas caps.

U.S. Pat. No. 4,040,487 discloses a method for producing gas from a geopressured reservoir by producing a well at a high rate for a period whereupon gas separates from the geopressured water to form a gas cap from which gas is then produced.

U.S. Pat. No. 3,134,434 discloses producing gas from a conventional water pressured gas reservoir by injecting water as gas is withdrawn to produce gas from the gas cap, reducing the reservoir pressure by removing a portion of the water from the reservoir, and then producing the residual gas remaining in the reservoir which has been water flooded into the top of the former gas cap.

Conventional water flooding with either cold or heated water to recover hydrocarbons in a secondary or tertiary recovery process by a drive front of water is well known to those skilled in the art.

The nation has a great need for additional natural gas reserves and a greatly increasing need for this resource. An economical method for producing methane or natural gas from geopressured water resources would go far toward alleviating the nation's energy needs. Improved and more economical methods for enhanced recovery of hydrocarbons from fields largely depleted by primary recovery methods is also urgently needed.

OBJECTS OF THE INVENTION

An object of the invention is to provide a process for economically feasible recovery of methane from geopressured gas-containing aquifers.

Another object of the invention is to provide a method for enhanced recovery of hydrocarbons from reservoirs which are at least partially depleted by primary recovery methods.

SUMMARY OF THE INVENTION

Natural gas (methane) is recovered from a geopressured natural gas-containing aquifer by a process comprising:

(a) producing aqueous liquid containing methane from the aquifer into a relatively low pressure reservoir, (b) allowing exsolvation of the methane from the aqueous liquid in the reservoir, and (c) producing the exsolvated methane from a structural high in the reservoir.

According to one aspect, methane containing aqueous liquids from a geopressured methane containing aquifer are injected into an injection well penetrating a hydrocarbon containing reservoir which has experienced production by primary production means, and hydrocarbons which are mobilized within the reservoir by movement of the injected aqueous liquid from the injection well toward the production well are recovered by way of a production well penetrating the reservoir.

DESCRIPTION OF THE DRAWING AND PREFERRED EMBODIMENTS OF THE INVENTION

Figure 1:
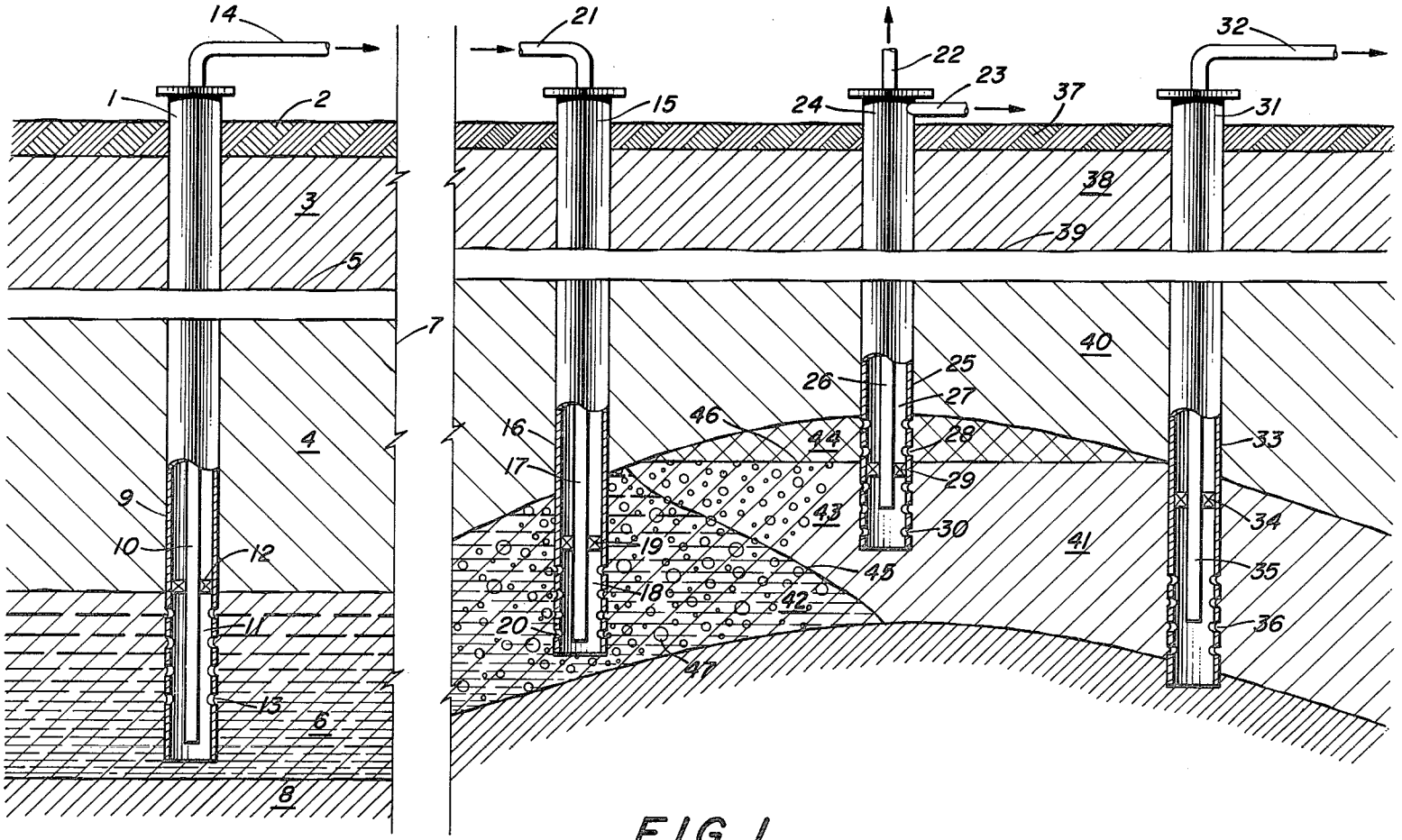
FIG. 1, illustrates a cross-sectional schematic illustrating production wells producing methane containing aqueous liquid from a geopressured aquifer with injection of the methane containing aqueous liquid into a depleted hydrocarbon containing reservoir and production of exsolvated gas and mobilized hydrocarbons therefrom.

A presently preferred embodiment of the invention is described with reference to the drawing by way of exemplification in order to more fully explain the invention and provide information to those skilled in the art on how to carry it out. However, it is to be understood that this exemplification is not intended to function as a limitation on the invention as described and claimed herein.

Referring to the drawing, to the left of the drawing, separated from the rest of the drawing by break 7, production well 1 penetrates the surface of the earth 2 overburden 3 and overburden 4 separated by break 5 and overlying geopressured methane containing aquifer 6 which overlies underburden 8. The well comprises casing 9 penetrating into aquifer 6 and communicating therewith by means of perforations 13. Production tubing 10 defines annulus 11 in combination with casing 9 and is set off by packer 12 providing for production of methane containing liquids from aquifer 6 through perforations 13, annulus 11 (below packer 12), and through production tubing 10 to the surface outlet 14.

The aqueous liquid in the aquifer is at very high geopressures and contains large amounts of dissolved methane.

The aqueous liquid containing dissolved methane produced from well 1 by way of outlet 14 is injected into the injection well 15 by way of inlet 21 and injection tubing 17 set off from casing 16 by means of packer 19 and forming annulus 18. The mixture then passes into relatively low pressure reservoir 41 overlain by overburden 40, separated by break 39 from overburden 38 and surface material 37.

As the relatively hot aqueous liquid containing dissolved methane is injected into the reservoir 41, it passes therethrough toward the production well sweeping resident hydrocarbons forward by heating the reservoir and by water flooding activity as indicated by front 45 separating a relatively hydrocarbon-poor zone 42 from relatively hydrocarbon-rich zone 43 of the reservoir. Bubbles of methane 47 exsolvate from the solution as pressure is decreased upon injection into the reservoir, and the bubbles rise through the reservoir to form gas cap zone 44 separated from the water-rich saturated zone 43 by interface 46. The methane accumulating in the gas cap 44 is produced from production well 24 through perforations 28 and through annulus 27 between casing 25 and producing tubing 26, and to surface facilities via outlet 23. Producting tubing 26 is set off from casing 25 by packer 29.

Fluids relatively rich in liquid hydrocarbons are produced through perforations 30, production tubing 26, and through outlet 22 to surface separation and processing facilities.

As more hot aqueous fluid containing dissolved methane is injected into the reservoir by way of injection well 15, the reservoir may become pressured up, depending somewhat on the rates of withdrawal of liquids and gas from production well 24.

According to one embodiment, pressure relief well 31 is employed to produce largely aqueous liquids from the reservoir to maintain the reservoir 41 at a suitably lower pressure than the pressure of the geopressured aquifer, to insure suitable flow from the aquifer to the reservoir, and to insure efficient exsolvation of methane from the geopressured liquids produced from well 1 and injected by way of well 15 into the reservoir 41. Such largely aqueous liquids are produced by way of perforations 36 in casing 33 through production tubing 35 to outlet 32 and disposal facilities. Producing tubing 35 is set off from casing 33 by way of packer 34.

Pressure relief well 31 is not normally employed to reduce pressure during the early phases of the project, and it may not be required if reservoir strata in 41 extend over a broad area.

According to the invention, the geopressured aquifer can be separated both vertically and horizontally from the reservoir into which the geopressured liquids are produced (injected). The horizontal distance separating the reservoir and aquifer is limited only by the economics of building suitable pipelines and maintaining suitable temperatures of the fluids.

In certain geographic locations, the reservoir into which injection is made may overlie a suitable geopressured aquifer. In such case, the function of production well and injection well 15 can be combined in a suitable borehole by means of multiple perforations or suitable production tubing and packer arrangements as are apparent to those skilled in the art in the course of applying normal engineering knowhow.

It is not necessary to inject into a depleted or partially depleted hydrocarbon containing reservoir according to this invention. However, such is normally preferred because such reservoirs are already located, and are characterized in many instances by a history of production. However, it is entirely within the scope of this invention to inject geopressured liquids into a suitable aquifer having a trap for exsolvating gas or into a suitable formation having sufficient permeability and a formation trap to recover the exsolvating methane.

According to a presently preferred embodiment of this invention, the geopressured liquids injected into the formation mobilize hydrocarbons therein by heating effects, pressuring up effects, and miscible and/or water flooding effects well known to those skilled in the art.

According to another presently preferred embodiment, geopressured fluids are injected into a permeable structure having a stratigraphic high to collect a gas cap for production of methane but not being confined otherwise such that the lower lying liquids can flow more or less horizontally and dissipate into the earth. In such situations, pressure relief wells are not needed, even far into operation of the process.

It is also in accord with this invention to recover exsolvated gas from the aquifer from which the aqueous liquids are produced, in accord with the process described in U.S. Pat. No. 4,040,487, or otherwise.

According to a more specific embodiment and mode of operation, methane saturated salt water from overpressured Nodosaria "B" sandstones, Acadia Parish, Louisiana, are injected into the nearly depleted Nodosaria "A" gas reservoir of the Rayne Field. It is calculated that an additional 7½ billion cubic feet of natural gas can be thus produced. The gas exsolvates from solution while the reservoir is filling with salt water from the injected geopressured water production.

Methane solubility data indicate that about 49 cubic feet of gas per barrel of injection water is released initially when the pressure differential between the Nodosaria "A" and the Nodosaria "B" water source is greatest. This diminishes to about 33 cubic feet of gas per barrel as the Nodosaria "A" reaches hydrostatic pressure.

The Nodosaria "A" reservoir fills over a period of about five years at an injection rate of 100,000 barrels per day. The solution gas scavenges on the order of 200,000 to 400,000 barrels of condensate that otherwise would not be recovered from the reservoir. Influx of hot water and increased reservoir pressure also result in additional recovery of gaseous and liquid hydrocarbons from the reservoir.

I claim:

1. A process for recovery of methane from a geopressured aquifer which contains dissolved methane comprising:
   (a) producing the aqueous liquid which contains dissolved methane from the aquifer into a relatively low pressure reservoir having a structural high,
   (b) allowing exsolvation of the methane from the aqueous liquid which contains the dissolved methane within the reservoir and migration of the methane to the structural high, and
   (c) producing the exsolvated methane from the structural high in the reservoir.

2. The process of claim 1 wherein the relatively low pressure reservoir is a hydrocarbon containing reservoir which has experienced production by primary production claims.

3. The process of claim 2 wherein the relatively low pressure reservoir has been substantially depleted by primary production.

4. The process of claim 2 wherein the pressure in the relatively low pressure reservoir is maintained substantially below the pressure of the aquifer by producing migrated aqueous fluid from a structural low in the reservoir at a locus apart from the locus of injection of the methane containing aqueous liquid and also apart from the locus of production of the exsolvated methane.

* * * * *